US005908335A

United States Patent [19]

Satoh

[11] Patent Number: 5,908,335

[45] Date of Patent: Jun. 1, 1999

[54] CONTACT STRUCTURE OF SOCKET CONNECTOR

[75] Inventor: Hideaki Satoh, Miyagi-ken, Japan

[73] Assignee: Alps Electric Co., Ltd., Japan

[21] Appl. No.: 08/953,819

[22] Filed: Oct. 20, 1997

[30] Foreign Application Priority Data

Oct. 21, 1996 [JP] Japan ..... 8-278160

[51] Int. Cl.[6] ..... H01R 13/11

[52] U.S. Cl. ..... 439/857

[58] Field of Search ..... 439/856, 857, 439/842, 861

[56] References Cited

U.S. PATENT DOCUMENTS

| | | | |
|---|---|---|---|
| 2,235,780 | 3/1941 | Wagstaff | 439/842 |
| 3,622,954 | 11/1971 | Hovnanian et al. | 439/857 |
| 4,241,970 | 12/1980 | Rider, Jr. et al. | 439/856 |
| 4,702,545 | 10/1987 | Moyaert | 439/856 |
| 5,651,705 | 7/1997 | Hsu | 439/856 |

FOREIGN PATENT DOCUMENTS 08045592 2/1996 Japan .

*Primary Examiner*—Gary Paumen

*Attorney, Agent, or Firm*—Brinks Hofer Gilson & Lione

[57] ABSTRACT

A contact structure of a socket connector capable of shortening the arrangement pitch of socket contacts, and speeding up the processing cycle by simplifying the structure of a stamping die for the socket contacts. The socket contacts are formed by stamping an electrically conductive flat metal plate. Each socket contact is provided with a conductive section for taking on the contact with the other pin contact, a holding section to be press-fitted and fixed in an insulating housing, and a terminal section to be soldered on a circuit substrate. The conductive section is stamped out in the shape of a long strip having a smaller width than the holding section. A rectangular opening is formed at the center of the conductive section, and contact leaves are respectively formed at the inner side edges of a pair of planar spring sections which are opposed to each other through the opening. The contact leaves are positioned offset from each other in the lengthwise direction of the opening, and bent at an angle a little less than 90° with respect to the planes of the spring sections.

4 Claims, 11 Drawing Sheets

CONTACT STRUCTURE OF SOCKET CONNECTOR

BACKGROUND OF THE INVENTION

1. Field of the Invention

The present invention relates to a contact structure of a socket connector to be provided in a PC (Personal Computer) card or the like, and more particularly, to a contact structure of a socket connector which is suited to the shortening the arrangement pitch of socket contacts.

2. Description of the Related Art

Built into a PC card to be loaded into a notebook personal computer or the like are a socket connector including many socket contacts fixed on an insulating housing, a circuit substrate to be connected to the socket contacts, and the like. In attaching the PC card to a pin connector on the side of an external apparatus, contact pins of the pin connector are respectively inserted into the socket contacts from the leading end of the socket connector. In recent years, there has been a strong demand that the arrangement pitch of the socket contacts be shortened to, for example, 1.27 mm in such a socket connector of the PC card. Japanese Unexamined Patent Publication No. 8-45592 has proposed a socket connector which is adapted for such pitch reduction.

FIG. 24 is a side view of a socket contact in the socket connector disclosed in the aforesaid publication. As shown in FIG. 24, one socket contact 1 is provided with a pair of contact leaves 2 and 3 for gripping a contact pin to be inserted, a connecting section 4 for connecting the contact leaves 2 and 3, a holding section 5 to be press-fitted and fixed in a housing, and a terminal section 6 extending backward from the holding section 5. The contact leaves 2 and 3 are perpendicularly bent at the diagonal positions on the long narrow connecting section 4, and the holding section 5 extends backward from one contact leaf 2.

FIG. 25 is a development view showing a state in which an electrically conductive flat metal plate as a raw material of the socket contact 1 is stamped. As shown in FIG. 25, one contact leaf 3 of one socket contact crosses the other contact leaf 2 of the adjoining socket contact, and comes between the contact leaf 2 and the connecting section 4 of the adjoining socket contact. The electrically conductive flat metal plate thus stamped is perpendicularly bent at the positions shown by the two-dot chained lines in FIG. 25, thereby obtaining many socket contacts 1 arranged with a predetermined pitch P.

In a development state of the aforesaid conventional socket contacts before they are bent into the final shape, one of the contact leaves formed in one socket contact comes inside the contact leaf of the adjoining socket contact. Therefore, the arrangement pitch P of the socket contacts in stamping can be reduced to the small pitch required for the socket connector, and a socket connector having socket contacts arranged with a small pitch, for example, 1.27 mm, can be realized. However, on the other hand, the structure of a die for use in stamping the socket contacts is extremely complicated, which increases the die cost and impedes the speeding-up of the processing cycle.

SUMMARY OF THE INVENTION

Accordingly, it is an object of the present invention to provide a contact structure of a socket connector which shortens the arrangement pitch of socket contacts, and speeds up the processing cycle by simplifying the structure of a stamping die for the socket contacts.

In a development state of an electrically conductive flat metal plate which is stamped, a conductive section of a socket contact is stamped out so as to be narrower than a holding section for a housing, and the conductive section is provided with an opening punched at the widthwise center thereof, and contact leaves formed at side sections thereof opposed to each other through the opening. Consequently, since adjoining socket contacts are completely independent at stamping, the stamping die structure is simplified and the processing cycle is thereby speeded up. Moreover, since the spring for clamping the contact pin is secured by the sections positioned on both sides of the opening, good continuity between the contact pin and the contact leaves can be obtained.

According to a contact structure of a socket connector of the present invention, in a socket connector in which many socket contacts are fixed on an insulating housing with a required arrangement pitch and each of the socket contacts has a conductive section for receiving a contact pin of the other pin connector and a holding section to be press-fitted and fixed in the housing, an outline of the conductive section is stamped out so as to have a width equal to or less than that of the holding section, an opening is formed at the widthwise center of the conductive section, and contact leaves for clamping the contact pin are respectively formed at sections opposed to each other through the opening.

According to the above structure, the opening extends lengthwise along the inserting direction of the contact pin, and the contact leaves are respectively bent at the inner edges of a pair of planar spring sections opposed to each other through the opening, and offset from each other in the inserting direction of the contact pin, whereby a pair of contact leaves can be formed by efficiently using the space inside the opening.

Furthermore, according to the above structure, the opening extends lengthwise along the inserting direction of the contact pin, and curved spring leaves are respectively formed at the sections opposed to each other through the opening, and twisted toward the opening so that the center portions thereof are brought close to each other and serve as contact leaves. Consequently, the overall shape of the conductive section is simplified, and moreover, continuity between the contact pin and the contact leaves is stabilized by the planar contact of the contact pin with the contact leaves.

Still furthermore, according to the above structure, the conductive section is provided with a convex section having a pair of standing surfaces which are bent almost orthogonally to the inserting direction of the contact pin, and the standing surfaces have respective openings, and contact leaves are bent at the edges of the openings on opposite sides. Since the contact leaves are protected by the convex section, it is possible to reliably prevent the contact leaves from deformation during the manufacturing process.

DESCRIPTION OF THE PREFERRED EMBODIMENTS

Figure 1:
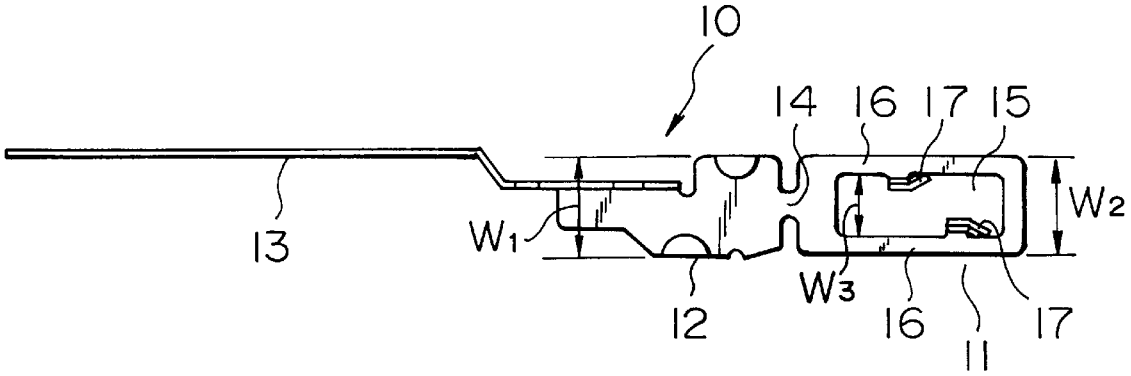
FIG. 1 is a plan view of a socket contact according to a first embodiment of the present invention.
Figure 2:
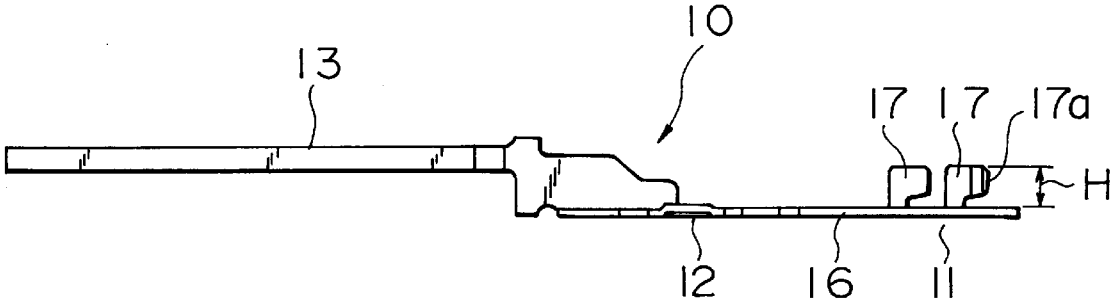
FIG. 2 is a side view of the socket contact.
Figure 3:
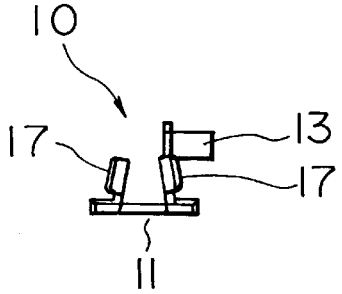
FIG. 3 is a front view of the socket contact.
Figure 4:
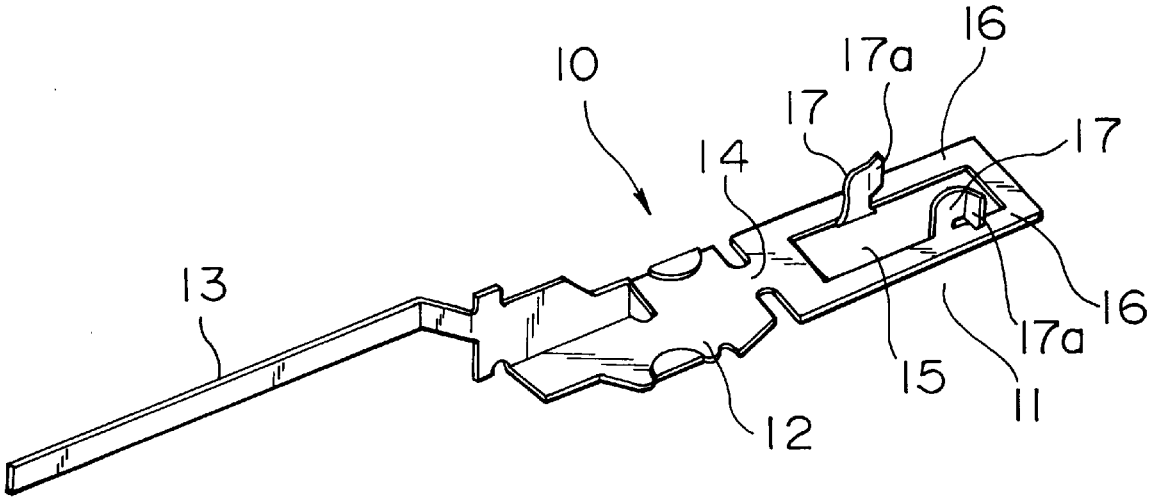
FIG. 4 is a perspective view of the socket contact.

The preferred embodiments of the present invention will be described with reference to the attached drawings. FIG. 1 is a plan view of a socket contact according to a first embodiment of the present invention, FIG. 2 is a side view of the socket contact, FIG. 3 is a front view of the socket contact, FIG. 4 is a perspective view of the socket contact, FIG. 5 is a view showing the manufacturing process of the socket contact, FIG. 6 is a plan view showing the principal part of a socket connector in which the socket contact is incorporated, FIG. 7 is a side view of the socket connector, and FIG. 8 is a front view of the socket connector.

As shown in FIGS. 1 to 4, a socket contact 10 of the first embodiment comprises three sections, a conductive section 11 for taking on the contact with the other pin contact, a holding section 12 to be press-fitted and fixed into an insulating housing, which will be described below, and a terminal section 13 to be soldered on an unillustrated circuit substrate. The terminal section 13 is bent at almost right angles to the plane of the holding section 12, and both sides of the holding section 12 are made uneven so as to serve as margins in press-fitting into the housing. The holding section 12 is connected to the conductive section 11 through a narrow section 14, and the conductive section 11, the narrow section 14 and the holding section 12 are located on the same plane. The conductive section 11 is shaped like a long strip, and the width $W_2$ thereof is set equal to or less than the width $W_1$ of the holding section 12 ($W_1 \geqq W_2$). A rectangular opening 15 is formed at the center of the conductive section 11, and a pair of planar sections divided by the opening 15 serve as spring sections 16. The spring sections 16 are respectively provided with contact leaves 17 at the positions on the inner edges thereof which are offset from each other in the longitudinal direction. These contact leaves 17 are each bent from the opening 15 at a little less angle than 90° with respect to the plane of the spring section 16. Further, the upper part of each contact leaf 17 is bent outward, and this bent portion serves as a lead-in section 17*a*. The height H of the contact leaf 17 is set equal to or less than the width $W_3$ of the opening 15 ($W_3 \geqq H$).

Figure 5:
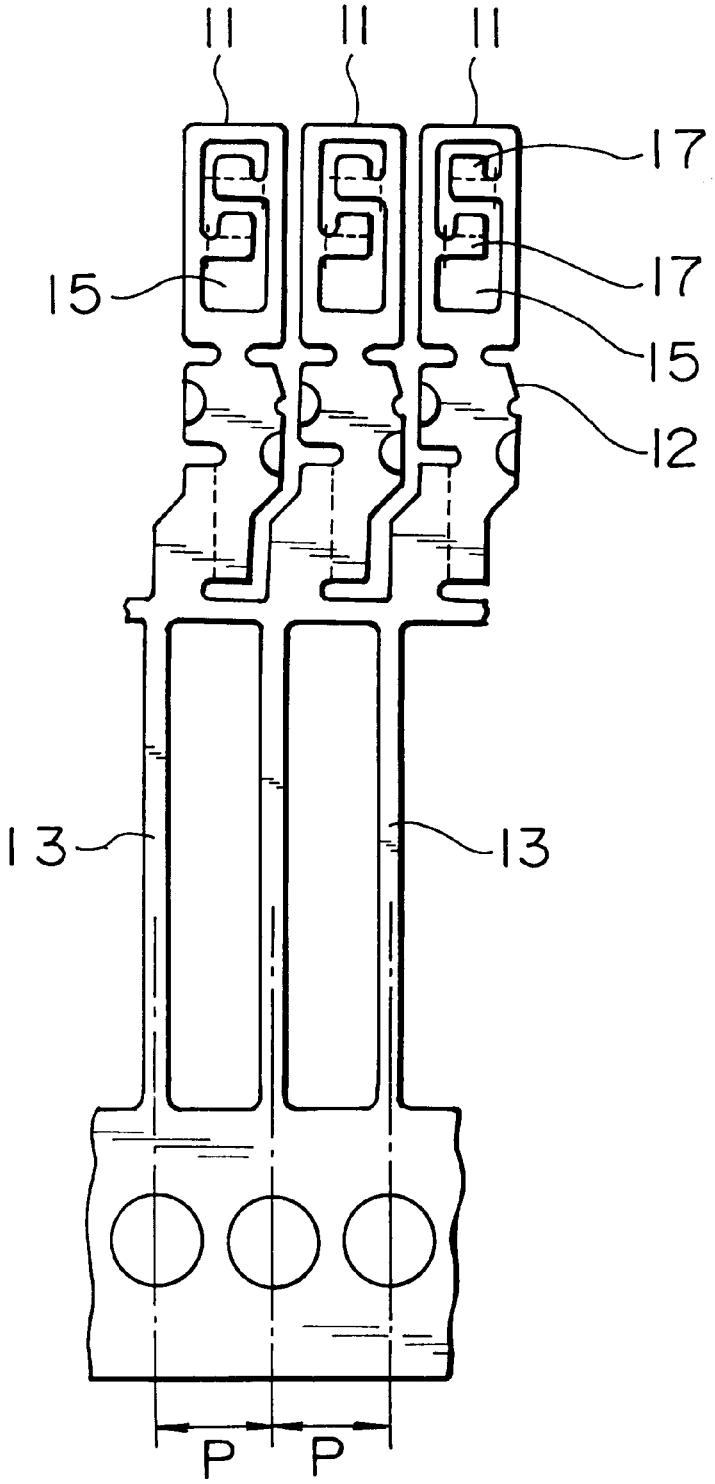
FIG. 5 is a view showing the manufacturing process of the socket contact.

As shown in FIG. 5, the socket contact 10 thus constructed is continuously manufactured by stamping a hoop-like electrically conductive flat metal plate and bending the stamped metal plate at the positions shown by the broken lines of FIG. 5. In this stamping, since the conductive section 11 of each socket contact 10 is completely independent and does not comes inside the adjoining conductive section 11, the stamping die structure is simplified, which makes it possible to reduce the die cost and to speed up the processing cycle. Further, since the contact leaves 17 are offset from each other in the longitudinal direction of the opening 15, the required height H thereof can be brought close to the width $W_3$ of the opening 15, and the arrangement pitch of the socket contacts 10 can be set at a small pitch of, for example, 1.27 mm. After worked into the final shape, each socket contact 10 is press-fitted into an insertion hole 19 of a housing 18 from the rear side thereof as shown in FIGS. 6 to 8, and the holding section 12 is retained by the inner wall of the insertion hole 19, whereby a socket connector including many socket contacts 10 fixed in the housing 18 with a required arrangement pitch is obtained.

Figure 6:
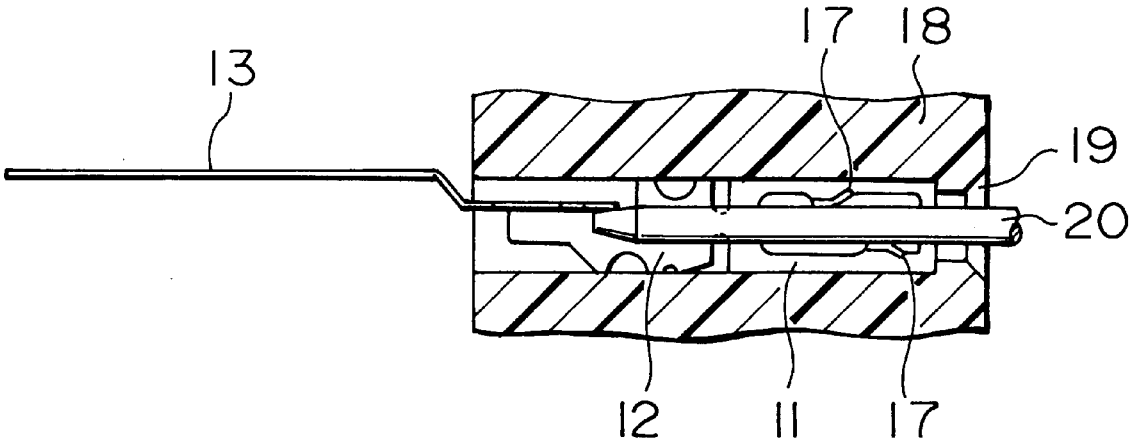
FIG. 6 is a plan view showing the principal part of a socket connector in which the socket contact is incorporated.
Figure 7:
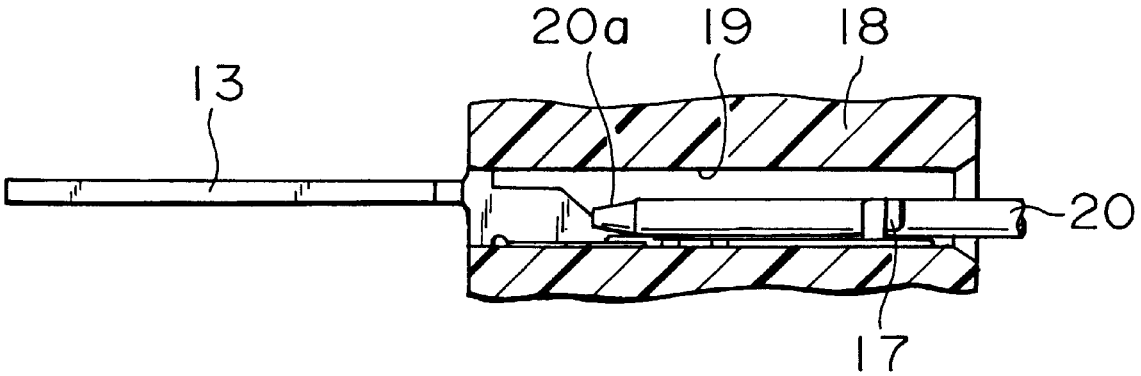
FIG. 7 is a side view of the socket connector.
Figure 8:
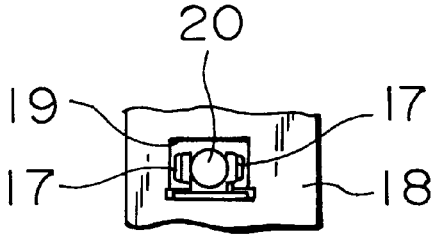
FIG. 8 is a front view of the socket connector.

When a PC card is loaded into a pin connector on the side of an external apparatus in use, a contact pin 20 of the pin connector is guided into the socket contact 10 by the insertion hole 19 of the socket connector attached to the PC card as shown in FIGS. 6 to 8. At this time, though the contact pin 20 is guided into the socket contact 10 somewhat eccentrically to the insertion hole 19, such eccentricity is corrected by the contact of a tapered surface 20*a* at the leading end of the contact pin 20 with the lead-in sections 17*a* of the contact leaves 17, and as a result, the contact pin 20 is properly guided by the contact leaves 17. When the PC card is further pressed in, since the tapered surface 20*a* of the contact pin 20 attempts to push the contact leaves 17 outward, the spring sections 16 for supporting the contact leaves 17 are twisted, and the contact leaves 17 are made by the reaction force to clamp the contact pin 20 at a stable contact pressure.

Figure 9:
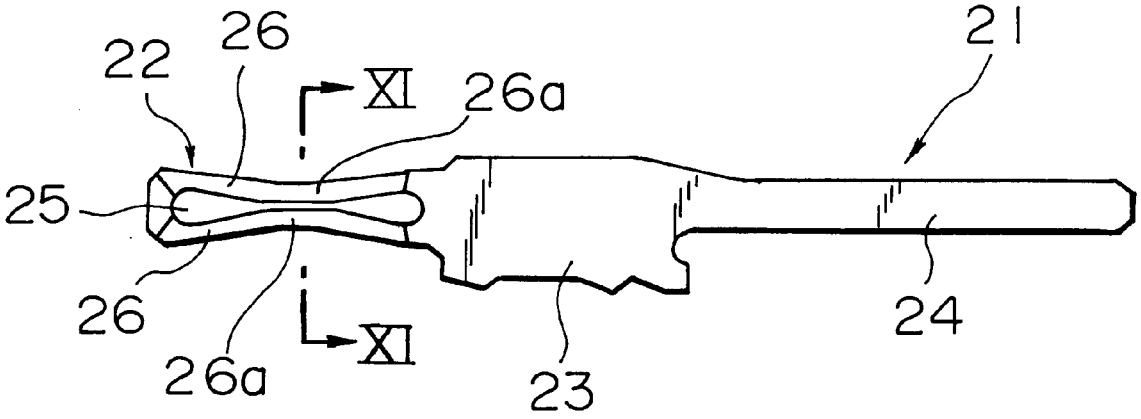
FIG. 9 is a plan view of a socket contact according to a second embodiment of the present invention.
Figure 10:
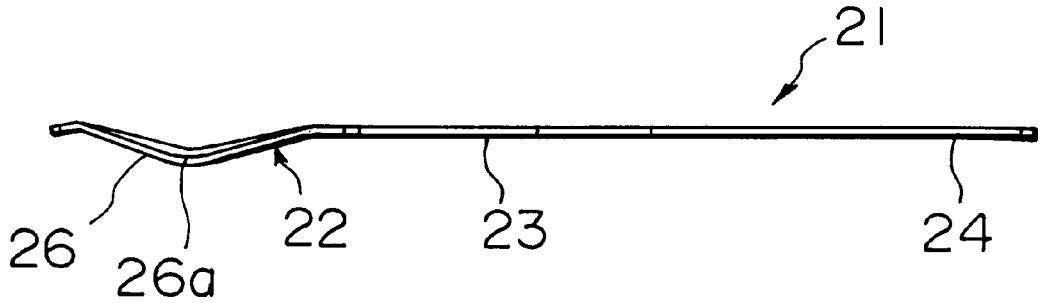
FIG. 10 is a side view of the socket contact.
Figure 11:
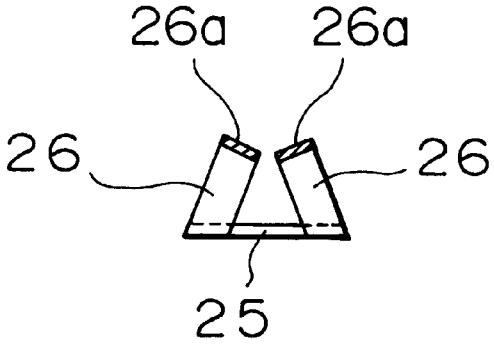
FIG. 11 is a cross-sectional view taken along the line XI—XI of FIG. 9.
Figure 12:
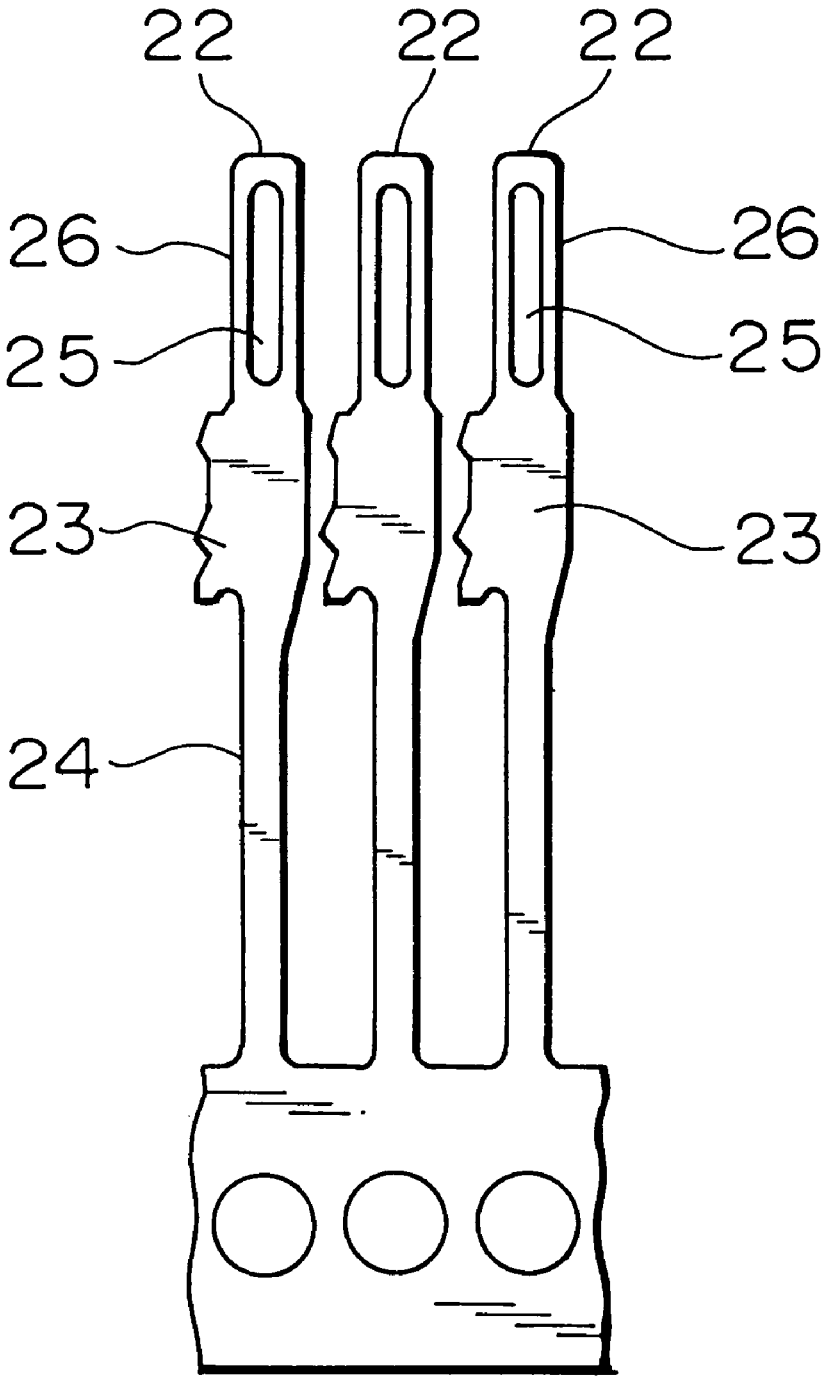
FIG. 12 is a view showing the manufacturing process of the socket contact.
Figure 13:
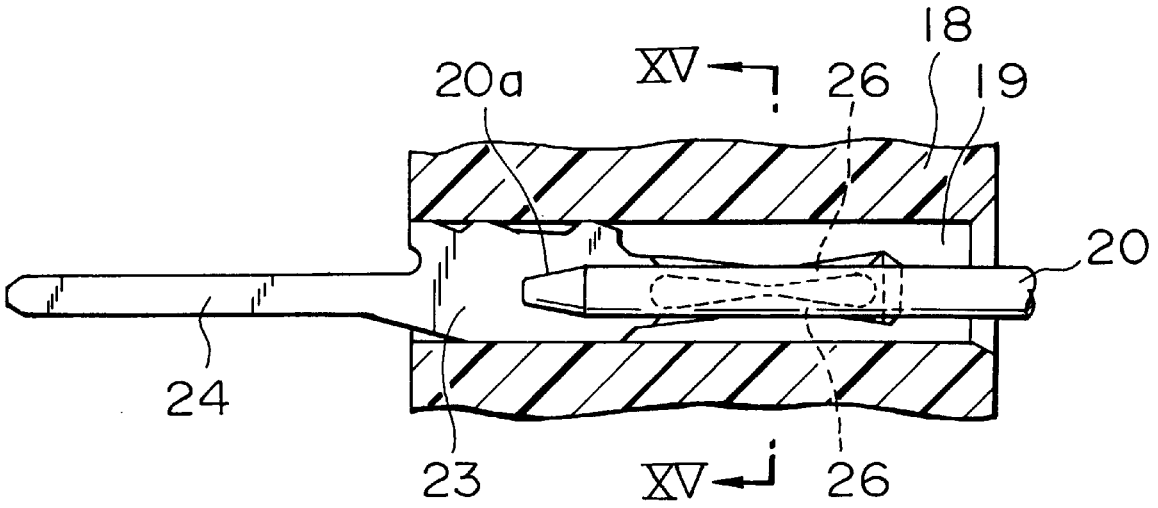
FIG. 13 is a plan view showing the principal part of a socket connector in which the socket contact is incorporated.
Figure 14:
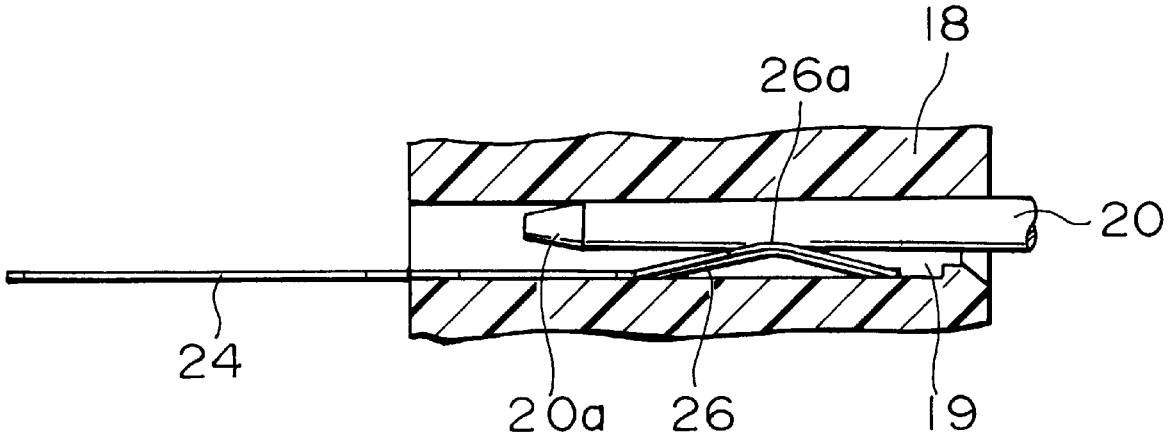
FIG. 14 is a side view of the socket connector.
Figure 15:
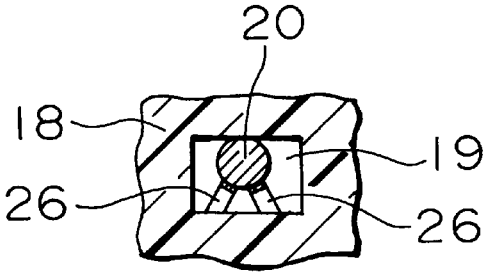
FIG. 15 is a cross-sectional view taken along the line XV—XV of FIG. 13.

FIG. 9 is a plan view of a socket contact according to a second embodiment of the present invention, FIG. 10 is a side view of the socket contact, FIG. 11 is a cross-sectional view taken along the line XI—XI of FIG. 9, FIG. 12 is a view showing the manufacturing process of the socket contact, FIG. 13 is a plan view showing the principal part of a socket connector in which the socket contact is incorporated, FIG. 14 is a side view of the socket connector, and FIG. 15 is a cross-sectional view taken along the line XV—XV of FIG. 13.

Although, as shown in FIGS. 9 to 11, a socket contact 21 according to the second embodiment also comprises three sections, a conductive section 22 for taking on the contact with the other pin contact, a holding section 23 to be press-fitted and fixed in a housing, and a terminal section 24 to be soldered on a circuit substrate, the holding section 23 and the terminal section 24 are connected to each other on the same plane, as distinct from the first embodiment. The conductive section 22 has a smaller width than the holding section 23, and is provided with a rectangular opening 25 at the center thereof. Sections opposed to each other through the opening 25 serve as a pair of spring leaves 26. The spring leaves 26 are curved and twisted toward the opening 25 to be brought close to each other at the centers thereof, whereby contact leaves 26*a* opposed close to each other in the shape of the letter V are formed at the centers of the spring leaves 26.

The socket contact 21 thus constructed is continuously manufactured by stamping a hoop-like electrically conductive flat metal plate into an outline and simply curving the spring leaves 26. Therefore, the stamping die structure is further simplified compared to the above-mentioned socket contact 10 in the first embodiment, which makes it possible to reduce the die cost and to speed up the processing cycle. After worked into the final shape, each socket contact 21 is press-fitted into an insertion hole 19 of a housing 18 from the rear side thereof as shown in FIGS. 13 to 15, and the holding section 23 is retained by the inner wall of the insertion hole 19, whereby a socket connector including many socket contacts 21 fixed in the housing 18 with a required arrangement pitch is obtained.

When a PC card is loaded into a pin connector on the side of an external apparatus in use, a contact pin 20 of the pin connector is guided into the socket contact 21 by the insertion hole 19 of the socket connector attached to the PC card as shown in FIGS. 13 to 15. When a tapered surface 20*a* at the leading end of the contact pin 20 reaches with the contact leaves 26, the contact pin 20 is pressed toward the valley between the contact leaves 26 which are opposed close to each other in the shape of the letter V. When the PC card is further pressed in, since the contact pin 20 presses the contact leaves 26*a* toward the valley, the spring leaves 26 including the contact leaves 26*a* are bent, and the contact leaves 26*a* are allowed by the reaction force to contact with the contact pin 20 at a stable pressure.

Figure 16:
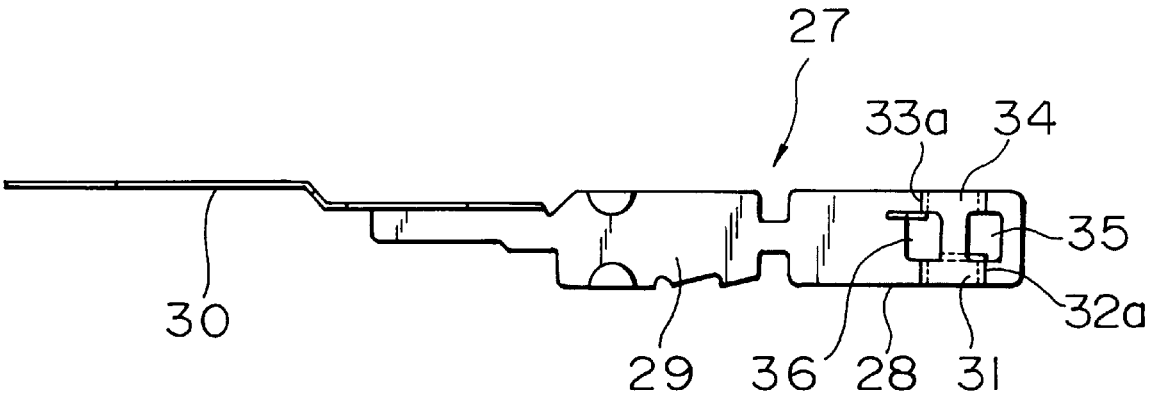
FIG. 16 is a plan view of a socket contact according to a third embodiment of the present invention.
Figure 17:
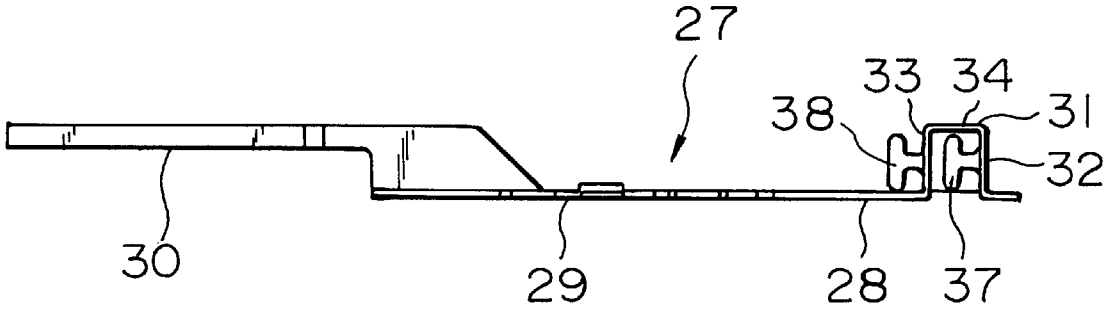
FIG. 17 is a side view of the socket contact.
Figure 18:
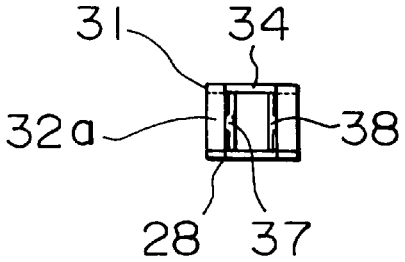
FIG. 18 is a front view of the socket contact.
Figure 19:
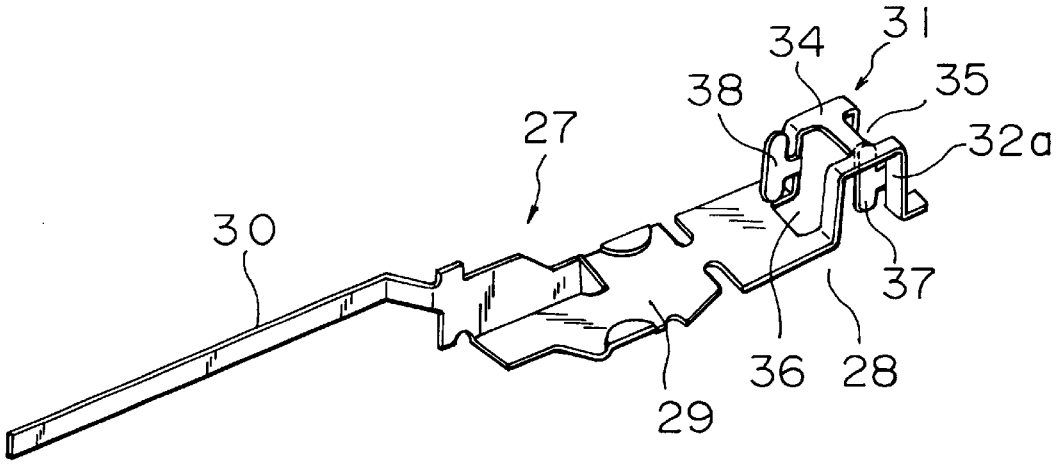
FIG. 19 is a perspective view of the socket contact.
Figure 20:
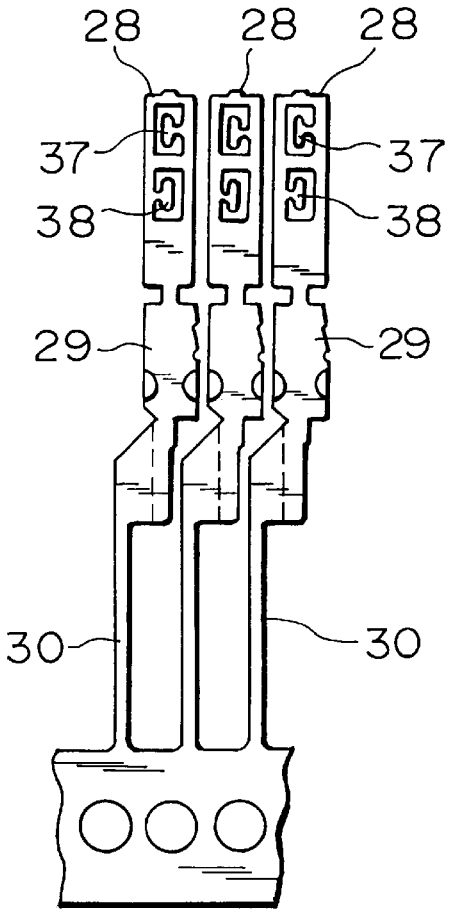
FIG. 20 is a view showing the manufacturing process of the socket contact.
Figure 21:
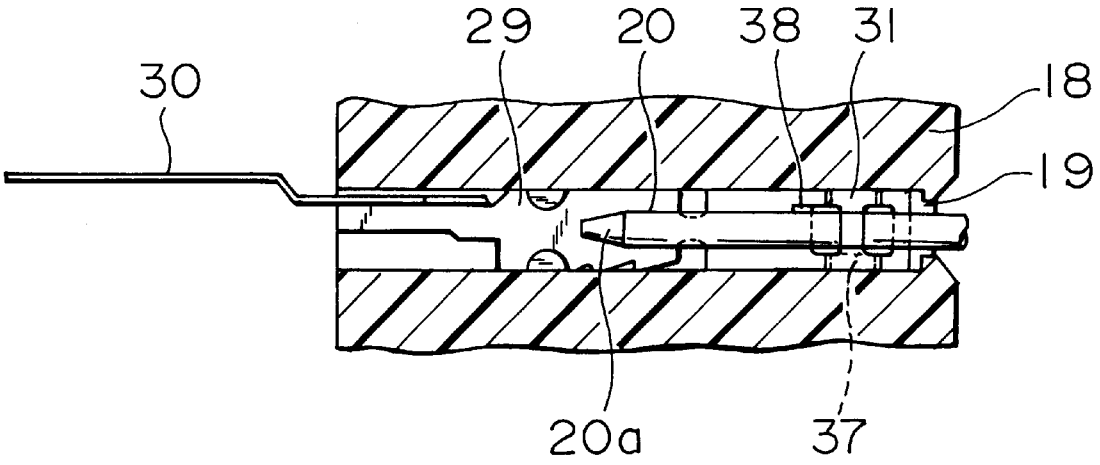
FIG. 21 is a plan view showing the principal part of a socket connector in which the socket contact is incorporated.
Figure 22:
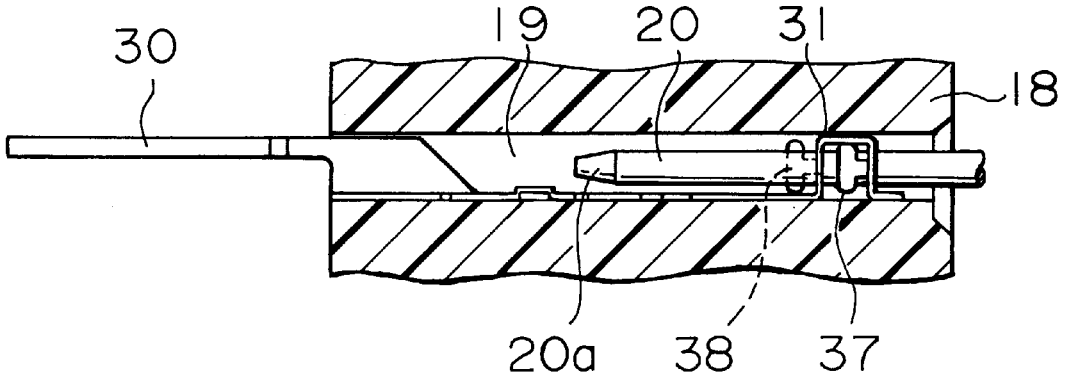
FIG. 22 is a side view of the socket connector.
Figure 23:
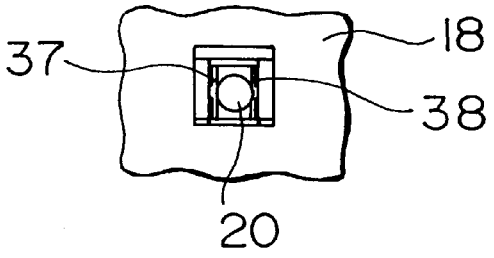
FIG. 23 is a front view of the socket connector.
Figure 24:
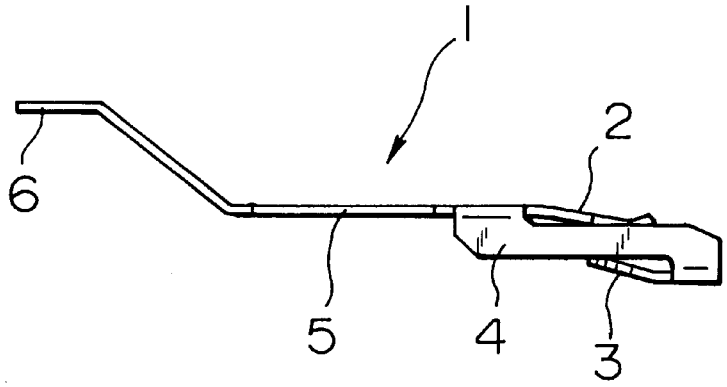
FIG. 24 PRIOR ART
FIG. 24 is a side view of a conventional socket contact.
Figure 25:
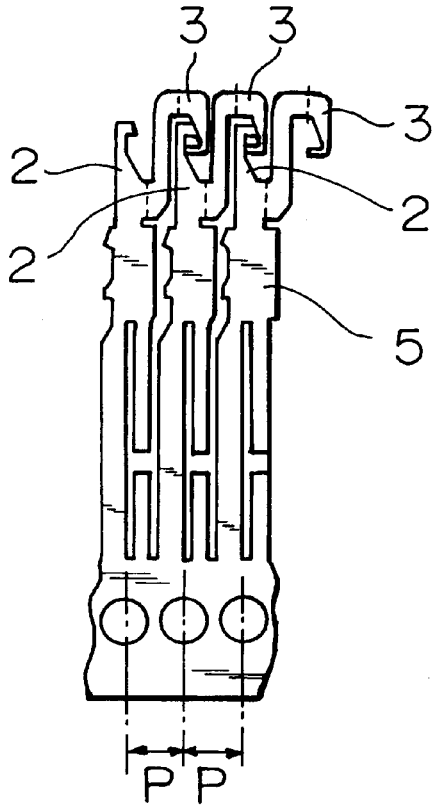
FIG. 25 PRIOR ART
FIG. 25 is a development view of the socket contact.

FIG. 16 is a plan view of a socket contact according to a third embodiment of the present invention, FIG. 17 is a side view of the socket contact, FIG. 18 is a front view of the socket contact, FIG. 19 is a perspective view of the socket contact, FIG. 20 is a view showing the manufacturing process of the socket contact, FIG. 21 is a plan view showing the principal part of a socket connector in which the socket contact is incorporated, FIG. 22 is a side view of the socket connector, and FIG. 23 is a front view of the socket connector.

Although, as shown in FIGS. 16 to 19, a socket contact 27 according to the third embodiment also comprises three sections, a conductive section 28 for taking on the contact with the other pin contact, a holding section 29 to be press-fitted and fixed in a housing and a terminal section 30 to be soldered on a circuit substrate, the socket contact 27 is different from the above-mentioned first embodiment in the shape of the conductive section 28. In other words, the conductive section 28 is narrower than the holding section 29, and a convex section 31 is formed to be bent on the plane thereof. The convex section 31 is composed of a pair of standing surfaces 32 and 33 and a connecting surface 34 for connecting the standing surfaces 32 and 33. The standing surfaces 32 and 33 are bent at almost right angles to the plane of the conductive section 28, and the connecting surface 34 is formed at almost right angles to the standing surfaces 32 and 33. The standing surfaces 32 and 33 are respectively provided with openings 35 and 36 at the center thereof, parts of which openings reach the plane of the conductive section 28 and the connecting surface 34. A part of the front standing surface 32 serves as a spring section 32*a*, and a contact leaf 37 is bent at the inner side edge of the spring section 32*a*. Further, a section of the rear standing surface 33, which is diagonally opposite to the spring section 32*a*, serves as a spring section 33*a*, and another contact leaf 38 is bent at the inner side edge of the spring section 33*a*. The contact leaves 37 and 38 extend toward the holding section 29, and the front spring section 32*a reaches the inside of the convex section 31.*

The socket contact 27 thus constructed is continuously manufactured, as shown in FIG. 20, by stamping a hoop-like electrically conductive flat metal plate and bending the stamped plate at the positions shown by the broken lines of FIG. 20. In this stamping, since the conductive section 281 of each socket contact 27 is completely independent and does not comes into the adjoining conductive section 28, the stamping die structure is simplified, which makes it possible to reduce the die cost and to speed up the processing cycle. Further, since the contact leaves 37 and 38 are protected by the convex section 31 at forming the convex section 31 by bending, they are reliably prevented from deformation during the manufacturing process. Moreover, since the parts of the openings 35 and 36 extend to the plane of the conductive section 28 and the connecting surface 34, the size of the contact leaves 37 and 38 can be brought close to the height of the standing surfaces 32 and 33. After worked into a final shape, each socket contact 27 is press-fitted into an insertion hole 19 of a housing 18 from the rear side thereof as shown in FIGS. 21 to 23, and the holding section 29 is retained by the inner wall of the insertion hole 19, whereby a socket connector including many socket contacts 27 fixed in the housing 18 with a required arrangement pitch is obtained.

When a PC card is loaded into a pin connector on the side of an external apparatus in use, a contact pin 20 of the pin connector is guided into the socket contact 27 by the insertion hole 19 of the socket connector attached to the PC card as shown in FIGS. 21 to 23, and penetrates through the openings 35 and 36 of the convex section 31. Since a tapered surface 20*a* of the contact pin 20 attempts to push the contact leaves 37 and 38 outward in that process, the spring sections 32*a* and 33*a* for supporting the contact leaves 37 and 38 are twisted, and the contact leaves 37 and 38 are made by the reaction force to clamp the contact pin 20 at a stable contact pressure.

The present invention is carried out by the above-mentioned embodiments, and has the following advantages.

In a development state of an electrically conductive flat metal plate which is stamped, a conductive section of a socket contact is stamped out so as to be narrower than a holding section for a housing, and the conductive section is provided with an opening punched at the widthwise center thereof, and contact leaves to be electrically connected to a contact pin, which contact leaves are respectively formed at side sections thereof opposed to each other through the opening. Consequently, since adjoining socket contacts are completely independent at stamping, the stamping die structure is simplified and the processing cycle is thereby speeded up. Moreover, since the spring for clamping the contact pin is secured by the sections positioned on both sides of the opening, good continuity between the contact pin and the contact leaves can be obtained.

Furthermore, the opening extends lengthwise along the inserting direction of the contact pin, and the contact leaves are respectively bent at the inner side edges of a pair of planar spring sections opposed to each other through the opening, and the contact leaves are offset from each other in the inserting direction of the contact pin, whereby a pair of contact leaves can be formed by efficiently using the space inside the opening.

Still furthermore, the opening extends lengthwise along the inserting direction of the contact pin, and curved spring leaves are respectively formed at the sections opposed to each other through the opening, and twisted toward the opening so as to bring the center sections thereof close to each other. The center sections serve as the aforesaid contact leaves. Consequently, the overall shape of the conductive section is simplified, and moreover, continuity between the contact pin and the contact leaves is stabilized by the planar contact of the contact pin with the contact leaves.

Still furthermore, the conductive section is provided with a convex section having a pair of standing surfaces which are bent almost orthogonally to the inserting direction of the contact pin, the standing surfaces have respective openings, and contact leaves are bent at the edges of the openings on opposite sides. Since the contact leaves are protected by the convex section, it is possible to reliably prevent the contact leaves from deformation during the manufacturing process.

What is claimed is:

1. A contact structure of a socket connector including a plurality of socket contacts fixed in an insulating housing with a required arrangement pitch, each of said socket contacts having a conductive section for receiving a contact pin of a pin connector, said conductive section having a widthwise center, and a holding section to be press-fitted and fixed in said housing, wherein an outline of said conductive section is stamped out so as to have a width equal to or less than that of said holding section, an opening is formed at the widthwise center of said conductive section, said conductive section forming a closed loop around said opening to thereby define said opening, and contact leaves for clamping said contact pin are respectively formed at sections of said conductive section opposed to each other through said opening and each of said contact leaves extending from said conductive section along a single direction.

2. A contact structure of a socket connector according to claim 1, wherein said opening extends in lengthwise along the inserting direction of said contact pin, and further comprising a pair of planar spring sections located opposed to each other through said opening, and offset from each other in the inserting direction of said contact pin, said spring sections having inner edges, said spring sections located on opposite sides said opening, wherein said contact leaves are respectively bent at the inner edges of said pair of planar spring sections.

3. A contact structure of a socket connector according to claim 1, including a plurality of socket contacts fixed in an insulating housing with a required arrangement pitch, each of said socket contacts having a conductive section for receiving a contact pin of a pin connector, and a holding section to be press-fitted and fixed in said housing, wherein an outline of said conductive section is stamped out so as to have a width equal to or less than that of said holding section, said conductive section is provided with a convex section having a pair of standing surfaces bent almost orthogonally to the inserting direction of said contact pin, said conductive section having a connecting surface which connects the standing surfaces, said standing surfaces having respective openings, and said contact leaves are bent at the edges of said openings on opposite sides.

4. A contact structure of a socket connector including a plurality of socket contacts fixed in an insulating housing with a required arrangement pitch, said housing including a plurality of insertion holes having inner walls, each of said socket contacts having a conductive section for receiving a contact pin of a pin connector, and a holding section to be press-fitted and fixed in said housing, wherein an outline of said conductive section is stamped out so as to have a width equal to or less than that of said holding section, said opening extends lengthwise along the inserting direction of said contact pin, and curved spring leaves are respectively form at sections opposed to each other through said opening, and twisted toward said opening so that center portions thereof are brought close to each other and made to serve as said contact leaves, each of said contact leaves extending along a single direction and wherein said contact pin is clamped between said inner walls of an insertion hole of the housing and said contact leaves.

* * * * *